US007247093B2

(12) United States Patent
Rothkranz

(10) Patent No.: US 7,247,093 B2
(45) Date of Patent: Jul. 24, 2007

(54) GAMING DEVICE HAVING A MECHANICAL SECONDARY DISPLAY

(75) Inventor: Markus Rothkranz, Las Vegas, NV (US)

(73) Assignee: IGT, Reno, NV (US)

( * ) Notice: Subject to any disclaimer, the term of this patent is extended or adjusted under 35 U.S.C. 154(b) by 623 days.

(21) Appl. No.: 10/243,049

(22) Filed: Sep. 12, 2002

(65) Prior Publication Data

US 2004/0053658 A1 Mar. 18, 2004

(51) Int. Cl.
*A63F 9/24* (2006.01)

(52) U.S. Cl. ..... 463/16

(58) Field of Classification Search ..... 463/16, 463/20, 12; 273/368, 369, 143 R
See application file for complete search history.

(56) References Cited

U.S. PATENT DOCUMENTS 366,510 A * 7/1887 Rubin ..... 40/492
454,844 A * 6/1891 Brewerton et al. ..... 40/492
483,715 A * 10/1892 Fisher ..... 283/50
1,527,704 A * 2/1925 Ray ..... 40/492
1,718,898 A * 6/1929 Fagan ..... 273/143 R
2,545,644 A 3/1951 Benton et al.
3,854,230 A * 12/1974 Knaus et al. ..... 40/107
3,975,022 A 8/1976 Figueroa
4,321,673 A 3/1982 Hawwass et al.
4,410,178 A 10/1983 Partridge
4,695,053 A 9/1987 Vazquez, Jr. et al.
4,722,527 A * 2/1988 Gauselmann ..... 273/143 R
4,732,386 A 3/1988 Rayfiel
4,775,155 A 10/1988 Lees
5,031,346 A * 7/1991 Herring et al. ..... 40/463
5,046,737 A 9/1991 Fienberg
5,102,137 A 4/1992 Ekiert (Continued)

FOREIGN PATENT DOCUMENTS

DE 38 04 862 A 10/1988

(Continued)

OTHER PUBLICATIONS

Slot Machines A Pictorial History of the First 100 Years, Marshall Fey, Fifth Edition, p. 5.*

(Continued)

*Primary Examiner*—Corbett B. Coburn
*Assistant Examiner*—Jasson H. Yoo
(74) *Attorney, Agent, or Firm*—Bell, Boyd & Lloyd LLP

(57) ABSTRACT

A gaming device having a mechanical display device for displaying selected images to a player. The mechanical display has a plurality of display plates which each display an image. In one embodiment, the display plates are each pivotally connected to an axle and each display plate independently moves to a plurality of positions. In at least one of the positions, the display plates are in alignment so that at least one display plate blocks at least part of the image displayed by another display plate. The gaming device selects an image displayed by one of the display plates and causes the display plates in front of the display plate displaying the selected image to move and reveal the selected image to the player, or moves the display plate displaying the selected image to a position so that the player can view the selected image.

34 Claims, 7 Drawing Sheets

U.S. PATENT DOCUMENTS 5,152,529 A 10/1992 Okada
5,205,555 A 4/1993 Hamano
5,342,047 A 8/1994 Heidel et al.
5,364,100 A 11/1994 Ludlow et al.
5,395,111 A 3/1995 Inoue
5,449,173 A 9/1995 Thomas et al.
5,536,016 A 7/1996 Thompson
5,560,603 A 10/1996 Seelig et al.
5,584,763 A 12/1996 Kelly et al.
5,611,535 A 3/1997 Tiberio
5,664,998 A 9/1997 Seelig et al.
5,766,074 A 6/1998 Cannon et al.
5,788,573 A 8/1998 Baerlocher et al.
5,823,872 A 10/1998 Prather et al.
5,823,874 A 10/1998 Adams et al.
D400,597 S 11/1998 Hedrick et al.
D402,702 S 12/1998 Seelig et al.
5,848,932 A 12/1998 Adams
5,851,148 A 12/1998 Brune et al.
5,855,514 A 1/1999 Kamille
5,873,781 A 2/1999 Keane
D406,865 S 3/1999 Heidel
5,882,261 A 3/1999 Adams
5,894,261 A * 4/1999 Green ..... 340/323 R
5,911,418 A 6/1999 Adams et al.
5,927,714 A 7/1999 Kaplan
5,947,820 A 9/1999 Morro et al.
5,976,015 A 11/1999 Seelig et al.
5,984,781 A 11/1999 Sunaga
5,996,997 A 12/1999 Kamille
5,997,401 A 12/1999 Crawford
6,004,207 A 12/1999 Wilson, Jr. et al.
6,015,346 A 1/2000 Bennett
6,033,307 A 3/2000 Vancura
6,059,289 A 5/2000 Vancura
6,059,658 A 5/2000 Mangano et al.
6,086,066 A 7/2000 Takeuchi et al.
6,089,976 A 7/2000 Schneider et al.
6,089,977 A 7/2000 Bennett
6,089,978 A 7/2000 Adams et al.
6,102,798 A 8/2000 Bennett
6,105,962 A 8/2000 Malavazos et al.
6,113,098 A 9/2000 Adams
6,126,542 A 10/2000 Fier
6,142,873 A 11/2000 Weiss et al.
6,142,874 A 11/2000 Kodachi et al.
6,149,156 A 11/2000 Feola
6,155,925 A 12/2000 Giobbi et al.
6,159,095 A 12/2000 Frohm et al.
6,159,097 A 12/2000 Gura
6,159,098 A 12/2000 Slomiany et al.
6,162,121 A 12/2000 Morro et al.
6,168,523 B1 1/2001 Piechowiak et al.
6,173,955 B1 1/2001 Perrie et al.
6,174,234 B1 1/2001 Seibert, Jr. et al.
6,174,235 B1 1/2001 Walker et al.
6,190,254 B1 2/2001 Bennett
6,190,255 B1 2/2001 Thomas et al.
6,203,429 B1 3/2001 Demar et al.
D441,031 S 4/2001 Seelig et al.
6,213,876 B1 4/2001 Moore, Jr.
6,220,593 B1 4/2001 Pierce et al.
6,224,483 B1 5/2001 Mayeroff
6,227,970 B1 5/2001 Shimizu et al.
6,231,442 B1 5/2001 Mayeroff
6,231,445 B1 5/2001 Acres
D443,313 S 6/2001 Brettschneider
6,251,013 B1 6/2001 Bennett
6,254,481 B1 7/2001 Jaffe
6,260,296 B1 7/2001 Carney, Jr.
6,261,177 B1 7/2001 Bennett
6,267,669 B1 7/2001 Luciano, Jr. et al.
6,270,411 B1 8/2001 Gura et al.
6,299,165 B1 10/2001 Nagano
6,302,790 B1 10/2001 Brossard
6,305,686 B1 10/2001 Perrie et al.
6,309,300 B1 10/2001 Glavich
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,336,863 B1 1/2002 Baerlocher et al.
6,340,158 B2 1/2002 Pierce et al.
6,343,988 B1 2/2002 Walker et al.
6,346,043 B1 2/2002 Colin et al.
6,347,996 B1 2/2002 Gilmore et al.
6,364,766 B1 4/2002 Anderson et al.
6,364,767 B1 4/2002 Brossard et al.
6,368,216 B1 4/2002 Hedrick et al.
6,386,974 B1 5/2002 Adams
6,398,220 B1 6/2002 Inoue
6,419,579 B1 7/2002 Bennett et al.
6,439,995 B1 8/2002 Hughs-Baird et al.
6,457,714 B1 10/2002 Feola
6,461,241 B1 10/2002 Webb et al.
6,464,582 B1 10/2002 Baerlocher et al.
D465,531 S 11/2002 Luciano, Jr. et al.
6,481,713 B2 11/2002 Perrie et al.
6,506,118 B1 1/2003 Baerlocher et al.
6,514,141 B1 2/2003 Kaminkow et al.
6,533,660 B2 3/2003 Seelig et al.
6,537,152 B2 3/2003 Seelig et al.
6,575,830 B2 6/2003 Baerlocher et al.
6,582,307 B2 6/2003 Webb
6,585,591 B1 7/2003 Baerlocher et al.
6,599,185 B1 7/2003 Kaminkow et al.
6,602,137 B2 8/2003 Kaminkow et al.
6,609,972 B2 8/2003 Seelig et al.
6,712,694 B1 3/2004 Nordman
6,731,313 B1 5/2004 Kaminkow
6,802,775 B2 10/2004 Baerlocher et al.
2003/0064806 A1* 4/2003 Gordon et al. ..... 463/42

FOREIGN PATENT DOCUMENTS

DE 38 11 301 A 10/1989
DE 44 02 800 A 8/1995
EP 0688002 A1 12/1995
EP 0945837 A2 9/1999
EP 0984409 A2 3/2000
GB 371 199 A 4/1932
GB 762611 A 11/1956
GB 912685 12/1962
GB 2117952 A 10/1983
GB 2201821 A 9/1987
GB 2262642 A 6/1993
GB 2383668 A 11/2001
JP 08 160893 A 6/1996
JP 08 215404 A 8/1996
JP 10 328399 A 12/1998

OTHER PUBLICATIONS

4DU Dice Unit Advertisement written by starpoint.uk.com, printed on Sep. 3, 2002.
American Bandstand Brochure written by Anchor Games, published in 2001.
Big Shot!™ Advertisement published by Aristocrat Technologies, Inc., published in 2002.
Big Top Keno Advertisement published by Aristocrat Technologies, Inc., published in 2000.
Bonus Roulette Brochure written by F. Franco, not dated.
Buck's Roulette Brochure written by R. Franco, not dated.
Chariot's of Fortune Brochure written by R. Franco, not dated.

Classic Pot of Gold Brochure written by Ace Coin Equipment Ltd., not dated.
Cyberdyne Gaming Brochure written by Cyberdyne Gaming, not dated.
Elvira® Mistress of the Dark™ Advertisement written by IGT, published in 2002.
Elvis Hits Advertisement written by IGT, published in 1999.
Holy Smoke Brochure written by Impulse Gaming Ltd., not dated.
Jack and the Beanstalk™ Brochure written by AC Coin & Slot, not dated.
King of the Grill™ Brochure written by AC Coin & Slot, not dated.
Line-Up Brochure written by AC Coin & Slot, not dated.
Little Green Men Jr.™ Advertisement written by AC Coin & Slot, not dated.
Little Green Men Jr.™ Article written by Strictly Slots, published in Feb. 2003.
Miss America Brochure written by AC Coin & Slot, not dated.
Mix and Match Article written by Strictly Slots, published in Apr. 2002.
Mix and Match Advertisement published by AC Coin & Slot, not dated.
Money Grab Article written by Strictly Slots, published in Apr. 2001.
Monster Match Article written by Strictly Slots, published in Jan. 2002.
On The Money! Article written by Strictly Slots, published in Dec. 2000.
Payout!™ Advertisement written by www.csds.com/Gaming/Products/gPayout.htm, printed on Jan. 15, 2001.
Payout!™ Article written by Casino Data Systems, not dated.
Pick a Prize Brochure written by Acres Gaming Incorporated, published prior 2001.
Power Slotto Brochure published by AC Coin & Slot prior 2002.
Press Your Luck Brochure published by AC Coin & Slot prior to 2002.
Quick Pick Paytime Brochure written by Acres Gaming Incorporated, published prior to 2001.
R&B™ Brochure published by AC Coin & Slot, not dated.
Reel Dice Advertisement written by Gerber & Glass, published in 1936.
Royal Roulette Brochure written by Impulse Gaming Ltd., not dated.
Slot Machine Buyer's Handbook, A Consumer's Guide to Slot Machines written by David L. Saul and Daniel R. Mead, published in 1998.
Silver City Roundup Brochure published by AC Coin & Slot, not dated.
Slot Machines A Pictorial History of the First 100 Years, 5th edition written by Marshall Fey, published in 1983-1997.
Slot Machines on Parade, 1st edition written by Robert N. Geddes and illustrated by Daniel R. Mead, published in 1980.
Spin-A-Lot Brochure written by Acres Gaming Incorporated, published prior to 2001.
Take Your Pick Article written by Strictly Slots, published in Mar. 2001.
Yahtzee Bonus Advertisement written by Mikohn, published in 1999.
Addams Family Article written by Strictly Slots, published in 2000.
Buck's Roulette advertisement written by R. Franco, available prior to Sep. 12, 2002.
Caribbean Gold Brochure written by Aristocrat, published in 1998.
Jackpot Party Brochures and Articles written WMS Gaming, Inc., published in 1998.
Mega Jackpots news article, available prior to Sep. 12, 2002.
Party Time Psycho Cash Beast advertisement written by IGT, published in 1999.
Sphinx Brochure, written by Atronic Casino Technology, published in 1997.
Top Dollar Game advertisement written by IGT, published in 1998.
Wheel of Fortune advertisement written by IGT, published in 1998.
Wheel of Fortune advertisement written by IGT, published in 1999.
Wheel of Fortune Slots S2000 Series advertisement, published in 2002.
Wheel of Fortune Video Slots advertisement on the website http://www.igt.com/games/new_games/wheel.html, printed Mar. 21, 2001.

* cited by examiner

GAMING DEVICE HAVING A MECHANICAL SECONDARY DISPLAY

CROSS REFERENCE TO RELATED APPLICATIONS

This application relates to the following co-pending, commonly owned application: "GAMING DEVICE HAVING A MECHANICAL SECONDARY DISPLAY," Ser. No. 10/661,685.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a wagering gaming device having a mechanical display which reveals a symbol or an image to a player in an exciting and entertaining manner.

BACKGROUND OF THE INVENTION

Gaming device manufacturers strive to make wagering gaming devices that provide as much enjoyment, entertainment and excitement as possible to players. Providing interesting and exciting primary or base games and secondary or bonus games in which a player has an opportunity to win potentially large awards or credits is one way to enhance player enjoyment and excitement. Another way to enhance a player's enjoyment, entertainment and excitement with a gaming device is by including lights, sounds and other visual or audio or audio-visual effects in the gaming machines.

Some known gaming devices use mechanical devices such as reels or wheels to enhance the attraction of the machines to players and also to enhance the player's game playing experience. These mechanical devices enable a player to see physical movements of a game, a portion of a game, or a functional game event or element which increases the player's enjoyment of the game.

To increase player enjoyment and excitement, it is desirable to provide new and different mechanical devices in conjunction with wagering gaming devices.

SUMMARY OF THE INVENTION

One embodiment of the present invention includes a gaming device having a cabinet which supports a primary display. The primary display exhibits a primary wagering game to a player and the gaming device enables the player to play the primary wagering game displayed by the primary display. In one embodiment of the present invention, the gaming device enables a player to play a poker game such as a video draw poker game. A housing is connected to the top of the gaming device cabinet. In one embodiment, the housing supports an axle. A plurality of aligned mechanical members or display plates are suitably attached to the axle. The display plates are pivotally or rotatably connected to the axle in such a manner that in at least one position the display plates are horizontally aligned with each other. In this horizontal alignment position, the front display plate will block from the view of the player at least a portion of at least one of the display plates positioned behind it. An actuator or a plurality of actuators are coupled with the display plates to pivot or rotate the display plates to multiple positions such as horizontal or vertical positions. In one embodiment, the actuators cause the mechanical members to rotate in a manner such that each display plate may rotate independently of each other.

In one embodiment of the present invention, the display plates are horizontally aligned so that in an initial position the display plates in front block at least a portion of the display plates in the back from the view of a player. The gaming device's processor causes the actuators to rotate the display plates from the initial position so that the player is able to view the display plates behind the front display plates. Thus, the player initially viewing the mechanical display may only see the entire first or front display plate in the horizontal alignment. The processor causes the display plates to rotate to one or either side until a selected display plate can be seen.

It should be appreciated that in one embodiment the display plates are directly attached to the actuators which are supported by the housing. It should also be appreciated that other suitable mechanisms may be employed in accordance with the present invention.

The display plates may include images, symbols, awards, values or combinations thereof. In one embodiment of the present invention, each display plate includes a different image, symbol, award, value or combination thereof.

In one embodiment of the present invention, the display plates display gaming cards. The gaming cards are initially horizontally aligned with each other so that a player only sees the front card. Upon a triggering event in the primary poker game (as indicated above), the processor selects a gaming card to be displayed by the secondary display device and determines which display plate displays the selected gaming card. The processor causes the actuators to rotate the display plates having other gaming cards positioned in front of the display plate having the selected gaming card as well as that display plate so that the display plate having the selected card is revealed to the player. The player will see the cards rotating to either side or in some cases to one side until the selected card is displayed.

A player will feel a greater sense of anticipation and excitement from the present invention because the player will preferably be shown a number of images or symbols on other display plates before being shown the image or symbol selected by the gaming device. It should be appreciated that in one embodiment the displayed card can be used in conjunction with one or more of the video poker hands to the player by the display device. It should also be understood that the gaming cards displayed by the display plates may be used in poker games or other gaming devices as wild cards or additional or bonus cards given to or usable by the player during the course of the game.

In one embodiment of the present invention, the housing includes a non-viewable area. When the display plates move into a position in the non-viewable area, the images displayed by the display plates cannot be seen by the player. In one embodiment, the display plates remain in the non-viewable area until one or more of the images displayed by the display plates are selected by the processor. The processor causes the selected display plate(s) to move from the non-viewable area into a viewable area where plate(s) can be seen by the player. If more than one of the display plates are selected, the display plates are moved into a variety of positions so that each image displayed by each display plate can be seen by the player. In this manner, the player will see a plurality of images or values displayed by the display plates. Thus, it should be appreciated that symbols or images or multiple display plates may be provided or usable to the player in conjunction with a game such as a primary game or secondary game.

In one embodiment, the housing encloses the plurality of display plates. It should be appreciated that the housing may also display images preferably corresponding to the theme of the game played on the gaming device. It should also be appreciated that the housing may also support different display devices and/or indicators in addition the mechanical display plates.

It should be appreciated that a triggering event which causes the actuation or activation of the mechanical display plates can occur in a primary or secondary game.

It is therefore an object of the present invention to provide a new and exciting display for wagering gaming devices.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
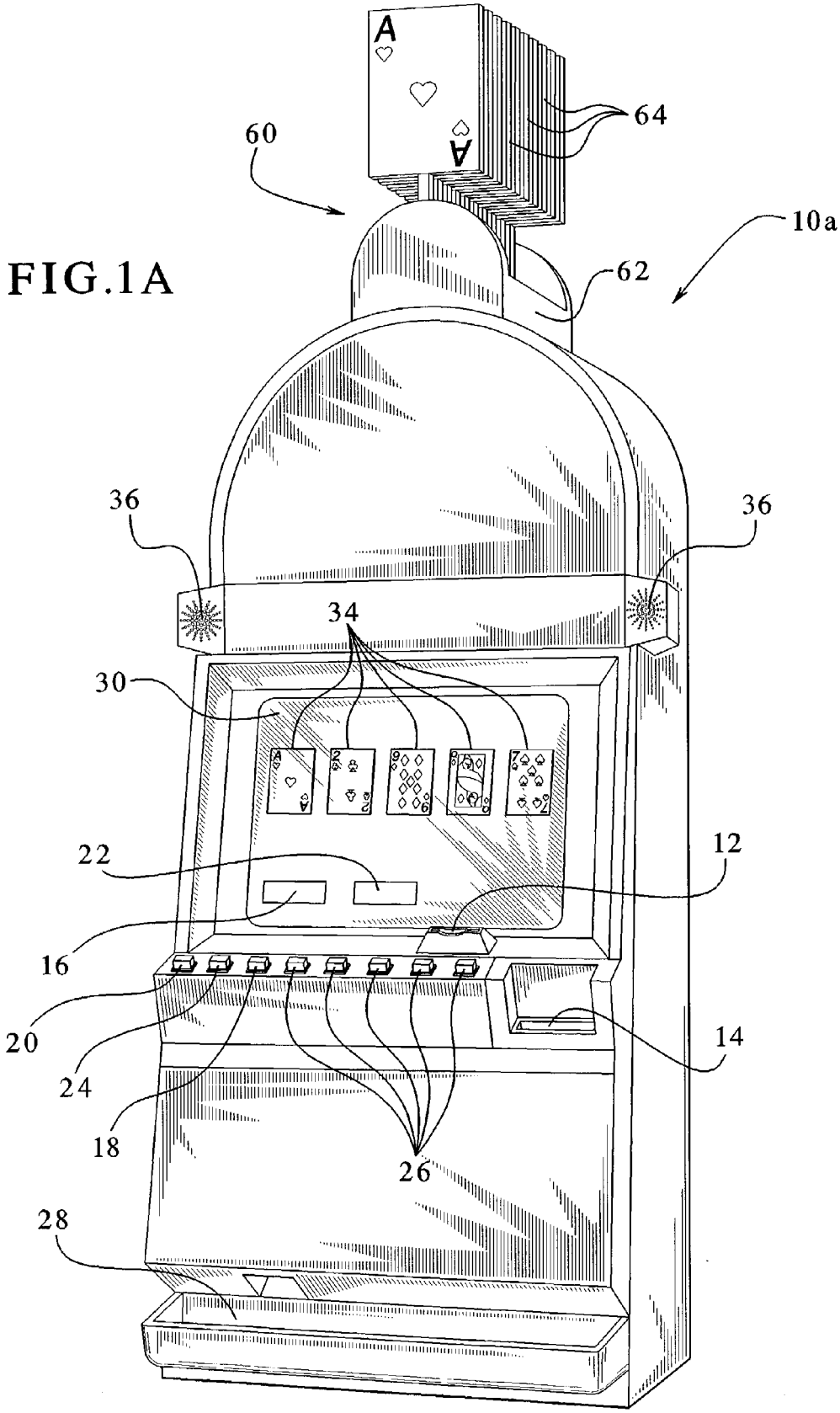
FIGS. 1A and 1B are front elevational views of general embodiments of the gaming device of the present invention.
Figure 1B:
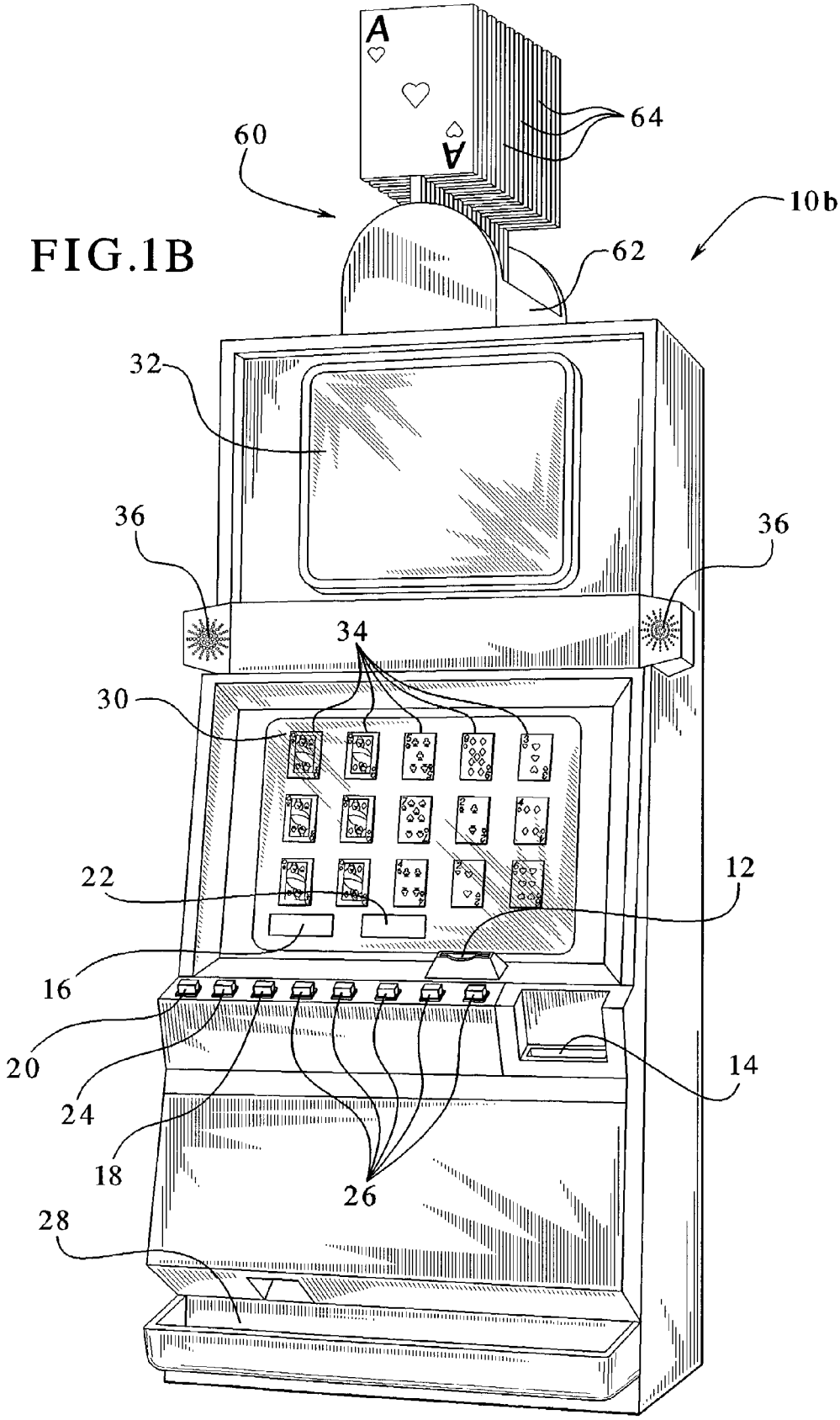

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 in one embodiment has the controls, displays and features of a conventional video poker machine. It is constructed so that a player can operate it while standing or sitting, and gaming device 10 is preferably mounted in a cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B.

Gaming device 10 can incorporate any primary game such as slot, poker, blackjack or keno, and any of the bonus triggering events and bonus games associated with these primary games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pushing a play or deal button 20. The play or deal button 20 can be any activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. Other bet or wager indicators such as a bet max button may also be employed in the gaming device of present invention.

A player may cash out and thereby receive a number of coins corresponding to the number of remaining credits by pushing a cash out button 18. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes a plurality of display devices. As shown in FIG. 1A, one embodiment includes a central display device 30 and also a mechanical display device 60. FIG. 1B includes a central display device 30 as well as an upper display device 32 and a mechanical display device 60. The gaming device 10 in one embodiment displays a plurality of cards 34 in video form by the central display device 30 and a plurality of cards 64 in mechanical form by the mechanical display device 60. The central display device can be any viewing surface such as glass, a video monitor or screen, a liquid crystal display, display plate or any other display mechanism. One preferred representation of the cards 34 is in video form wherein the preferred display device is a video monitor. The cards 64 are also preferably displayed in mechanical form and one preferred display device includes a plurality of display plates 64. The cards portray one or more decks of cards used in conventional poker games. The display plates may alternatively display a variety of images or symbols such as bells, hearts, fruits, numbers, letters or other images which may correspond to a theme associated with the gaming device. Furthermore, the gaming device 10 preferably illustrates speakers 36 for producing sound such as music.

Figure 2:
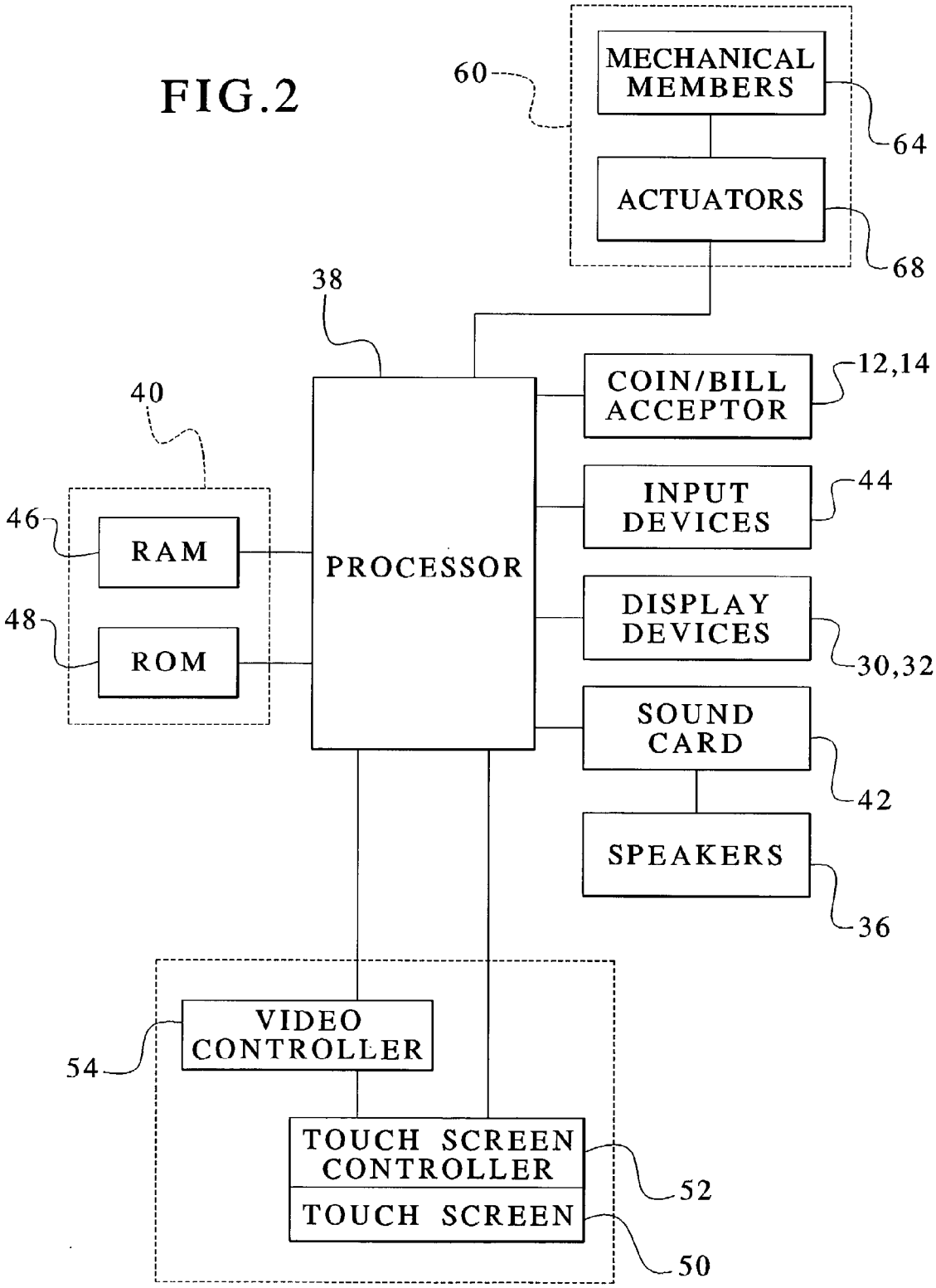
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a mechanical display device 60; a sound card 42; a plurality of speakers 36; and one or more input devices 44. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables. The memory device preferably stores program code which enables the gaming device to play a video poker game.

As illustrated in FIG. 2, the player preferably uses the input devices 44, such as the deal button 20, the bet one button 24, the hold cards buttons 24 and the cash out button 18 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a data network such as a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10, in one embodiment the player must insert the appropriate amount of money or tokens at coin slot 12 or bill acceptor 14 and then push the deal button 20. In one embodiment, the processor 38 enables the player to play a conventional game of video poker. In another embodiment, the controller enables a player to play a multi-hand version of video poker. In one embodiment, in either a bonus scheme or the primary game, the mechanical display 60 is used to display a gaming card 64 used in the primary or bonus game. In one embodiment, the mechanical display 60 is used to display the award(s) or value(s) which are provided to the player.

The Mechanical Display Device

Figure 3:
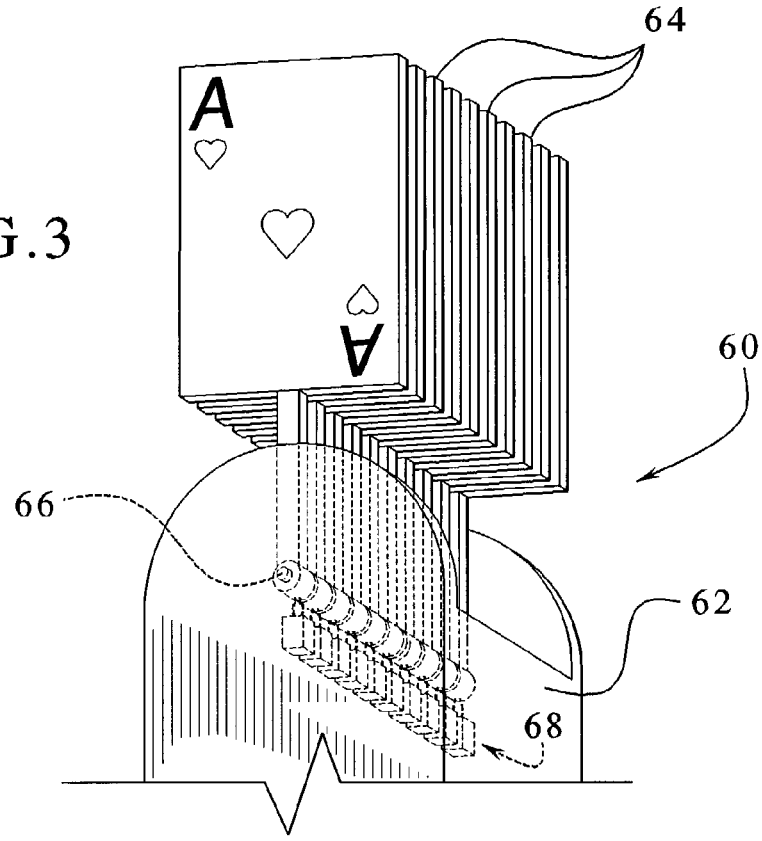
FIG. 3 is a front perspective view of the display device illustrating one embodiment of the present invention.
Figure 4:
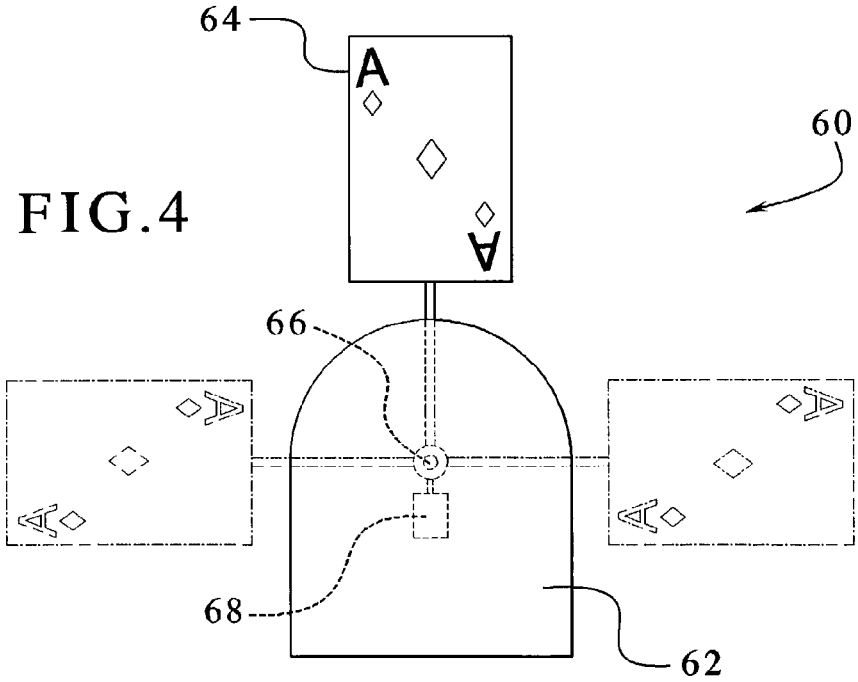
FIG. 4 is a front elevational view of the display device illustrating one embodiment of the present invention, wherein the display plates pivot about the axle.

In one embodiment of the present invention, the gaming device 10 includes a primary display 30, and a secondary mechanical display 60 as illustrated in FIGS. 1A and 1B. The secondary mechanical display is preferably connected to the top of the gaming device cabinet. The secondary mechanical display includes a housing 62 which supports an axle 66 along which a number of display plates 64 are suitably connected as shown in FIG. 3. In this embodiment, each display plate 64 is pivotally or rotatably connected to the axle 66 so that each display plate 64 may move to a horizontal, vertical or other suitable position as shown in FIG. 4.

Figure 5:
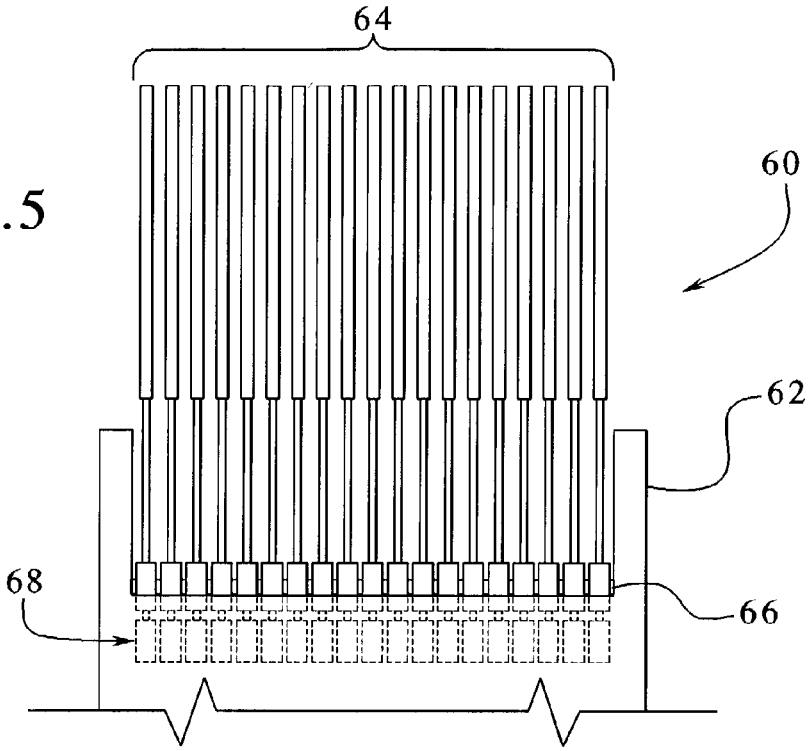
FIG. 5 is a side elevational view of the display device illustrating one embodiment of the present invention.

The display plates 64 in at least one position are horizontally aligned with each other as shown in FIG. 3 and in FIG. 5. Thus, in at least one position, a player will only see the entire image displayed by the front most display plate 64 as shown in FIG. 3. The front most display plate at least partially blocks from the view of the player the display plates which are behind the front most display plate.

Figure 6:
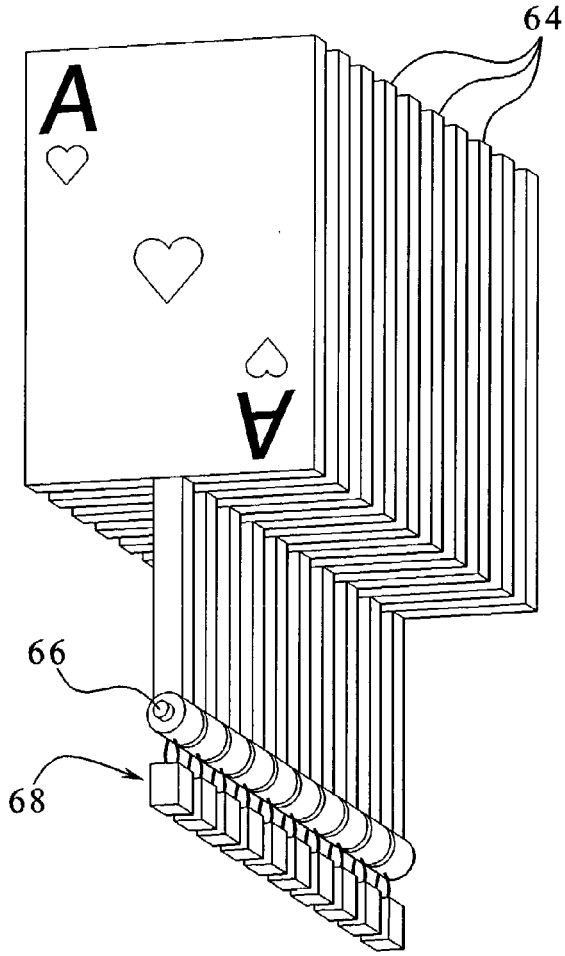
FIG. 6 is a front perspective view of a plurality of display plates in one embodiment of the present invention where the display plates are connected to an actuator.

In one embodiment of the present invention, at least one actuator 68 is connected to or coupled with each of the display plates 64 as shown in FIG. 6. In another embodiment of the present invention, the display plates 64 may be connected directly to the actuators 68 and are not connected to an axle. Such actuators 68 may in one embodiment be supported by the housing. It should be appreciated that the actuator may be any suitable device which causes the display plates to rotate such as a solenoid, a motor, a stepper motor, a biasing device (such as a spring or weighted means) or a combination of these devices.

Figure 7:
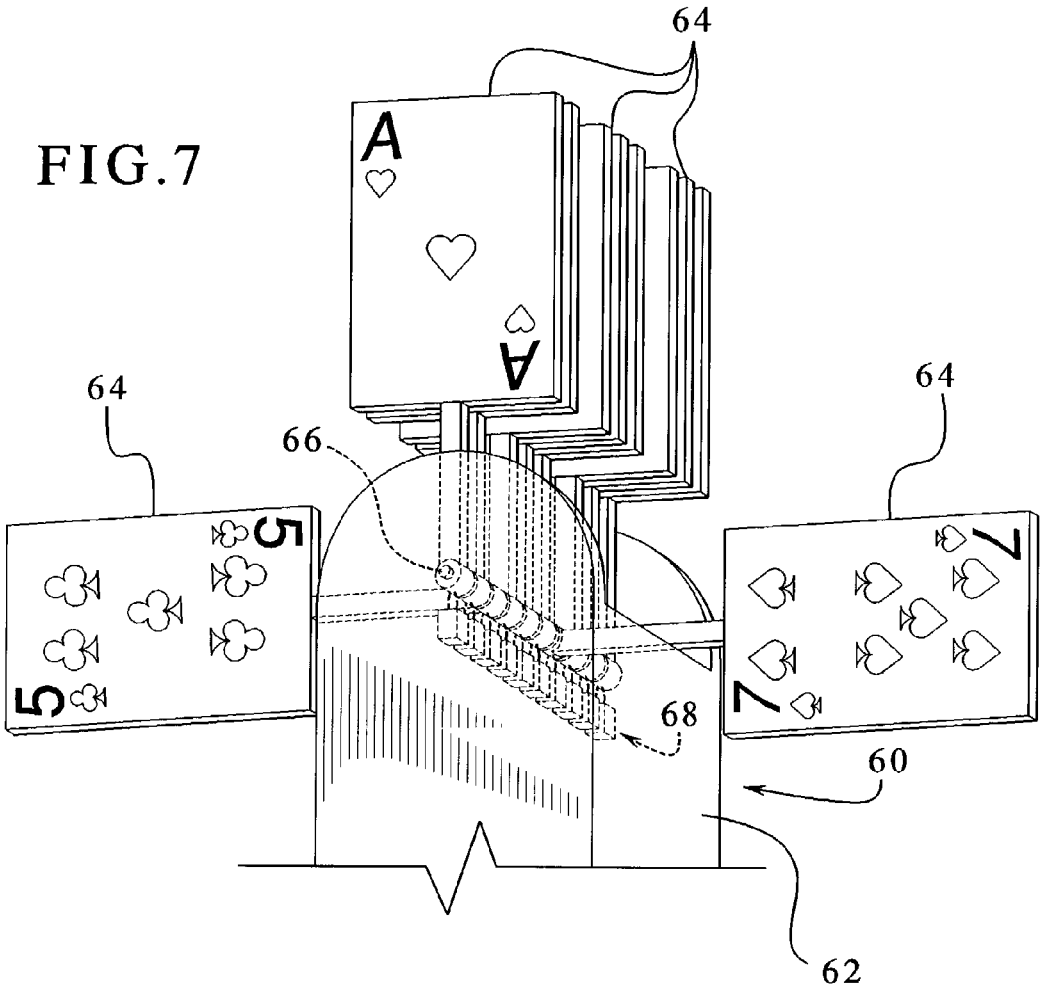
FIG. 7 is a front perspective view of the display device illustrating another embodiment of the present invention, wherein a number of display plates pivot independently.

The actuators 68 cause the display plates 64 to rotate independently of each other as shown in FIG. 7. Each display plate 64 may move to any suitable position, horizontal, vertical or at a non-horizontal or non-vertical angle, irrespective of the positions of the other display plates 64. Since each of the display plates 64 may also move independently of the other display plates 64, multiple display plates could move in different directions and at different rates and at different times.

Figure 8:
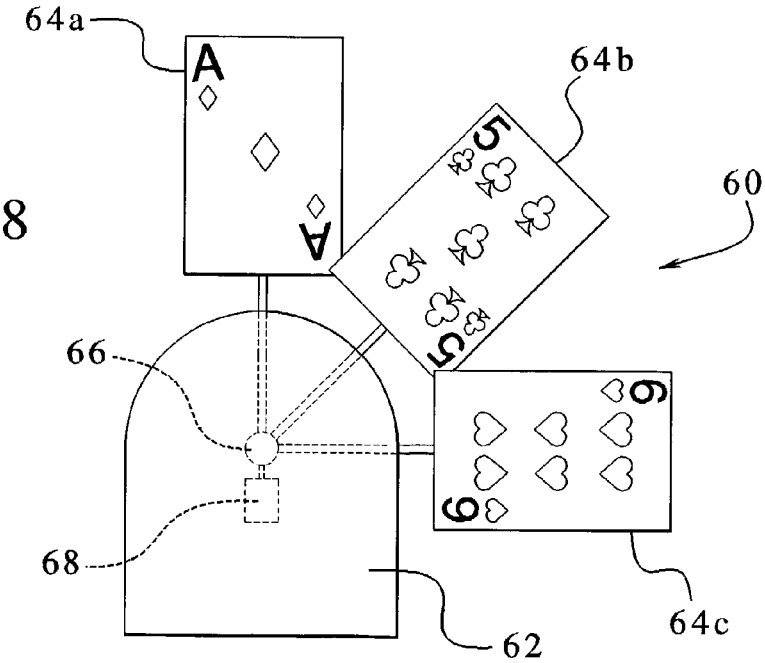
FIG. 8 is a front elevational view of the display device illustrating another embodiment of the present invention, wherein a plurality of display plates have moved to reveal a selected image.

In one embodiment of the present invention, the processor 38 is in communication with the primary display 30 which displays a game and following a triggering event in the game, the processor 38 selects an image associated with one of the display plates 64 to be displayed. The processor 38 then determines which of the display plates 64 displays the selected image. The processor 38 causes the display plates 64 in front of the display plate 64 displaying the selected image to rotate and reveal that display plate 64 displaying the selected image as shown. In FIG. 8, the display plate including the Six of Hearts 64*c* and the display plate including the Five of Clubs 64*b* move to reveal the selected display plate which includes the Ace of Diamonds 64*a*. In an alternative embodiment, the display plate having the selected image could also move. In a further alternative embodiment, all of the displays plates can move. In such embodiment, the selected display plate will ultimately stop in a position viewable by the player and indicated to be the selected display plate. In one alternative embodiment, the display plate having the selected image moves out of alignment with the other display plates.

In one embodiment of the present invention, the images displayed by the display plates are cards used in a conventional poker game. It should be appreciated that the present invention can be used in other card games or in other types of games. The processor enables a player to play a video poker game or some other card game using at least one display and upon a triggering event in the video card game, the processor selects one of the cards to be displayed by the mechanical display. The processor then determines which display plate displays the selected card and causes the display plates in front of the selected symbol to move in order to reveal the selected card to a player.

It should be appreciated that the cards displayed by the mechanical display could be used in a variety of ways, such as wild cards, or additional cards given to the player during the course of the card game.

Figure 9:
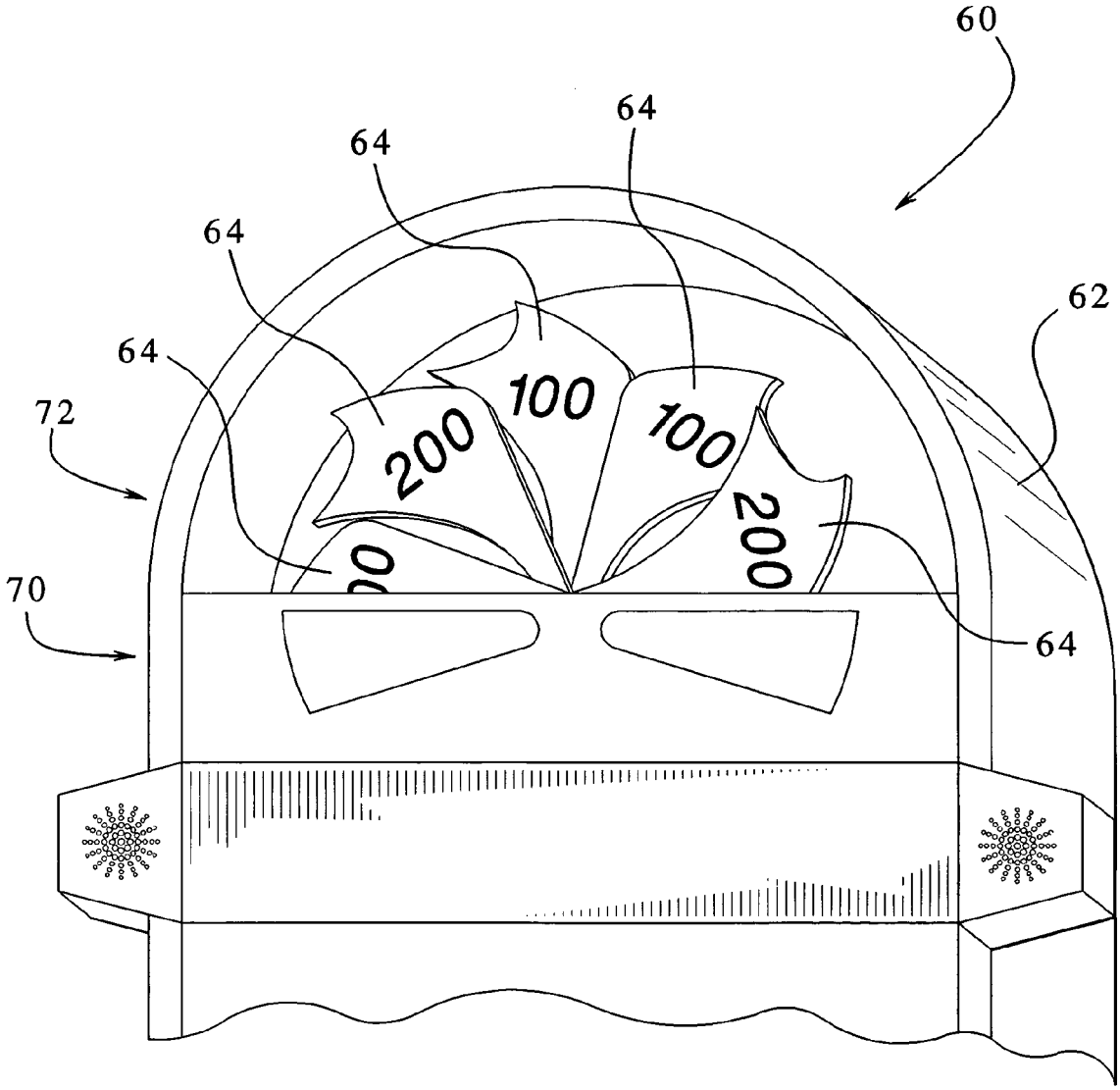
FIG. 9 is a front elevational of the display device illustrating another embodiment of the present invention, wherein the plurality of images displayed by the display plates include symbols and values.

In one embodiment of the present invention, the display plates 64 display images other than conventional gaming card symbols. The images displayed by the display plates include a plurality of value symbols as illustrated in FIG. 9. The housing 60 encloses the display plates 64 and the housing 60 itself displays images or symbols relating to the theme of the game played on the gaming device. The gaming device in this embodiment includes a non-viewable area 70, wherein the images displayed by the display plates 64, which are in a position in the non-viewable area 70, are hidden from the view of the player. In one embodiment, the processor 38 causes the display plates 64 to remain hidden from the view of the player until one or more of the images displayed by the display plates 64 are selected. The processor causes the display plate or plates 64 displaying the selected image or images to move into a viewable area 72 where the player can view the selected image(s). As illustrated by FIG. 9, the player can view a plurality of value symbols. The display plates 64 are in a plurality of positions where the player can view the selected images simultaneously. In this manner the player will feel excitement and anticipation as one or more of the value symbols displayed by the display plates 64 may be awarded to the player.

In one embodiment of the present invention, the display plates are in initial positions wherein a player can view the images displayed by each display plate. The processor selects the image(s) to be displayed to the player and causes the display plates displaying the non-selected images to move into a position in the non-viewable area, so that the only images the player sees are the images selected by the processor.

It should thus be understood that the mechanical display of the present invention can be used with a variety of gaming devices such as video poker machines, slot machines, blackjack machines, and keno machines.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the pending claims.

The invention is claimed as follows:

1. A gaming device operated under control of a processor comprising:

a cabinet;

a housing connected to the cabinet;

a display device controlled by the processor to display a game to a player;

a plurality of images;

a plurality of display plates, each display plate displaying one of the images, and being independently moveable to a plurality of different positions, wherein in at least one of said positions at least two display plates are in an alignment so that one of the display plates blocks at least part of the image displayed by the other display plate from the view of the player;

at least one actuator supported by the housing, each actuator connected to at least one of the display plates and operable after a triggering event in the game to cause said display plates to independently move to said positions; and an award associated with at least one of the displayed images on at least one of the independently moved plates, wherein said award is provided to the player.

2. The gaming device of claim 1, which includes an axle supported by said housing, wherein each display plate is pivotally connected to said axle.

3. The gaming device of claim 1, wherein said images include conventional gaming cards.

4. The gaming device of claim 1, wherein said images are selected from the group consisting of: value symbols and award symbols.

5. The gaming device of claim 1, wherein the housing encloses the plurality of display plates.

6. The gaming device of claim 1, wherein one of positions the display plates can be moved to is within a non-viewable area wherein said images displayed by the display plates cannot be seen by the player.

7. The gaming device of claim 1, which includes an independently activated actuator attached to each display plate.

8. A gaming device comprising:

a cabinet;

a housing connected to the cabinet;

a plurality of different images;

a plurality of display plates, each display plate displaying one of the images and being independently moveable to a plurality of different positions, wherein in at least one of said positions at least two of the display plates are in an alignment so that one of the two display plates blocks at least part of the image displayed by the other display plate from view by a player;

at least one actuator supported by the housing, each actuator connected to at least one of the display plates and operable to cause said display plates to independently move; and a processor operable with said actuators upon a triggering event to: (a) select one of the images displayed by one of the display plates; (b) determine which of said display plates displays the selected image; (c) cause said actuators to move any of said display plates in front of said display plate displaying the selected image to reveal said selected image to the player or move said display plate displaying said selected image to one of the positions where the player can view said image: and (d) provide an award to the player, the award associated with the selected image displayed by the display plate.

9. The gaming device of claim 8, which includes an axle supported by said housing, wherein each display plate is pivotally connected to said axle.

10. The gaming device of claim 8, wherein said images include conventional gaming cards.

11. The gaming device of claim 8, wherein said images include value symbols.

12. The gaming device of claim 8, wherein the housing encloses said plurality of display plates.

13. The gaming device of claim 8, wherein one of positions the display plates can be moved to is within a nonviewable area wherein said images displayed by the display plates cannot be seen by the player.

14. The gaming device of claim 8, wherein the processor causes a plurality of said display plates to move into a plurality of different positions so that the player may view each image displayed by each of said display plates.

15. The gaming device of claim 8, which includes an independently activated actuator attached to each display plate.

16. A method for operating a gaming device, said method comprising of:

(a) displaying a game to a player:

(b) selecting, after a triggering event in the game, an image to be displayed from a plurality of images, wherein each image of said plurality of images is displayed by one of a plurality of display plates and each of said display plates are independently movable to a plurality of different positions, wherein in at least one of the positions at least two of said display plates are in an alignment such that at least one of said display plates blocks at least part of the image displayed by another of said display plates from the view of the player, and wherein at least one award is associated with at least one of the images:

(c) determining which one of said plurality of display plates displays said selected image;

(d) moving any display plates which are in front of said display plate which displays said selected image until said selected image is revealed to the player; and (e) providing the player an award associated with said selected image.

17. The method of claim 16, wherein said images include conventional gaming cards.

18. The method of claim 16, wherein said images are selected from the group consisting of: value symbols and award symbols.

19. The method of claim 16, which includes selecting a plurality of said images, and moving said display plates displaying said selected images to a plurality of said positions, so that the player can view each selected image displayed by each of said display plates.

20. A method for operating a gaming device, said method comprising of:

(a) displaying a game to a player;

(b) selecting, after a triggering event in the game, an image to be displayed from a plurality of different images, wherein each image of said plurality of images is displayed by one of a plurality of display plates and each of said display plates is independently movable to a plurality of different positions, wherein in at least one of said positions, said display plates are in an alignment such that at least one display plate blocks at least part of the image displayed by another display plate from the view of the player;

(c) determining which of said plurality of display plates displays said selected image;

(d) moving at least one of the display plates such that said display plate displaying said selected image is in a position viewable by the player; and (e) providing an award to the player, the award associated with the selected image displayed by the display plate.

21. The method of claim 20, wherein one of positions of the display plates is within a non-viewable area wherein said images displayed by the display plates cannot be seen by the player.

22. The method of claim 20, wherein said images include conventional gaming cards.

23. The method of claim 20, wherein said images include value symbols.

24. A gaming device operable under control of a processor comprising:

a cabinet;

a housing connected to the cabinet;

a display device controlled by the processor to display a game to a player;

a plurality of images;

a plurality of display plates, each display plate displaying one of the images and being moveable to a plurality of different positions, wherein in at least one of said positions at least two display plates are in an alignment so that one of the display plates blocks at least part of the image displayed by the other display plate from the view of the player, and wherein at least one of said display plates is moveable to a different position while at least a different one of said display plates remains stationary;

at least one actuator supported by the housing, each actuator connected to at least one of the display plates and operable after a triggering event in the game to cause said display plates to independently move to said positions; and an award associated with at least one of the displayed images on at least one of the moved plates, wherein said award is provided to the player.

25. The gaming device of claim 24, which includes an axle supported by said housing, wherein each display plate is pivotally connected to said axle.

26. The gaming device of claim 24, wherein said images include conventional gaming cards.

27. The gaming device of claim 24, wherein said images are selected from the group consisting of: value symbols and award symbols.

28. The gaming device of claim 24, wherein the housing encloses the plurality of display plates.

29. The gaming device of claim 5, wherein one of positions the display plates can be moved to is within a non-viewable area wherein said images displayed by the display plates cannot be seen by the player.

30. The gaming device of claim 5, which includes an independently activated actuator attached to each display plate.

31. A method of operating a gaming device, said method comprising:

(a) displaying a game to a player;

(b) selecting, after a triggering condition in the game, an image to be displayed from a plurality of images, wherein each image of said plurality of images is displayed by one of a plurality of display plates and each of said display plates are movable to a plurality of different positions, wherein in at least one of the positions at least two of said display plates are in an alignment such that at least one of said display plates blocks at least part of the image displayed by another of said display plates from the view of the player, and wherein at least one of said display plates is moveable to a different position while at least a different one of said display plates remains stationary, and wherein at least one award is associated with at least one of the images;

(c) determining which one of said plurality of display plates displays said selected image;

(d) moving any display plates which are in front of said display plate which displays said selected image until said selected image is revealed to the player; and (e) providing the player any award associated with said selected image.

32. The method of claim 31, wherein said images include conventional gaming cards.

33. The method of claim 31, wherein said images are selected from the group consisting of: value symbols and award symbols.

34. The method of claim 31, which includes selecting a plurality of said images, and moving said display plates displaying said selected images to a plurality of said positions, so that the player can view each selected image displayed by each of said display plates.

* * * * *